US005178454A

United States Patent [19]

Lai

[11] Patent Number: 5,178,454

[45] Date of Patent: Jan. 12, 1993

[54] DECORATIVE LAMP POST

[76] Inventor: Wei-Cheng Lai, No. 74-5, Ching-Pu-Tzu, Ching-Pu Tsun, Hsin-Feng Hsiang Hsin-Chu Hsien, Taiwan

[21] Appl. No.: 826,784

[22] Filed: Jan. 28, 1992

[51] Int. Cl.[5] ..... F21V 33/00

[52] U.S. Cl. ..... 362/431; 312/153; 312/226; 312/396

[58] Field of Search ..... 362/431, 152, 153, 226, 362/314, 153.1, 145, 217, 219, 220, 312, 313, 316, 396, 154

[56] References Cited

U.S. PATENT DOCUMENTS 807,189 12/1905 McCarthy ..... 362/431

3,866,034 2/1975 Russo ..... 362/431

*Primary Examiner*—Ira S. Lazarus

*Assistant Examiner*—Y. Quach

*Attorney, Agent, or Firm*—Pro-Techtor International

[57] ABSTRACT

A decorative lamp post comprising essentially a post with a romantic configuration having one sharpened end to pierce into the ground and thus fixed therein and supported thereby. The post further has an expanded end on which a hole is formed to receive therein the sharpened end of another decorative lamp post of the present invention or the socket of a decoration lamp for holding a lamp. A plurality of fin-like members are longitudinally formed on the post for decoration and/or for attaching thereon another decoration lamps. Securing means also formed on the vicinity of the expanded end for securing a lamp-shade or a container for candies or the like.

5 Claims, 5 Drawing Sheets

DECORATIVE LAMP POST

FIELD OF THE INVENTION

The invention relates generally to a decorative lighting device and in particular to a post with a decorative configuration on which a socket is formed to receive therein a lamp, especially for installing in a garden or backyard in holding an outdoor party.

BACKGROUND OF THE INVENTION

In holding an outdoor party, people use lighting devices, such as decoration lamps to romanticize the environments. Heretofore, decoration lamps or lighting devices are usually installed or attached on trees, fences or walls or simply mounted on a post of a suitable length. This however may result in some damages or is not very loving. It is desirable to provide decorative lighting means which is romantic and good-looking in configuration and practical and convenient in use.

OBJECTS OF THE INVENTION

It is therefore an object of the present invention to provide a decorative lamp post which is romantic and beautiful in configuration and practical in use.

It is another object of the present invention to provide a decorative lamp post which comprises at least a lamp holder for holding decoration lamps.

It is a further object of the present invention to provide a decorative lamp post which is capable to be installed individually or in combination with another decorative lamp post of the present invention to adjust the height thereof.

It is a further object of the present invention to provide a decorative lamp post on which a plurality of decorations are attached individually or in combination.

To achieve the above-mentioned objects, there is provided a decorative lamp post comprising essentially a post with a romantic configuration having one sharpened end to pierce into the ground and thus fixed therein and supported thereby. The post further has an expanded end on which a hole is formed to receive therein the sharpened end of another decorative lamp post of the present invention or the socket of a decoration lamp for holding the lamp. A plurality of fin-like members are longitudinally formed on the post for decoration and/or for attaching thereon another decoration lamps. Securing means also formed on the vicinity of the expanded end for securing a lamp-shade or a container for candies or the like.

Other objects and advantages of the invention will be apparent from the following description of the preferred embodiments taken in connection with the accompanying drawing wherein:

DETAILED DESCRIPTION OF THE PREFERRED EMBODIMENTS

Figure 1:
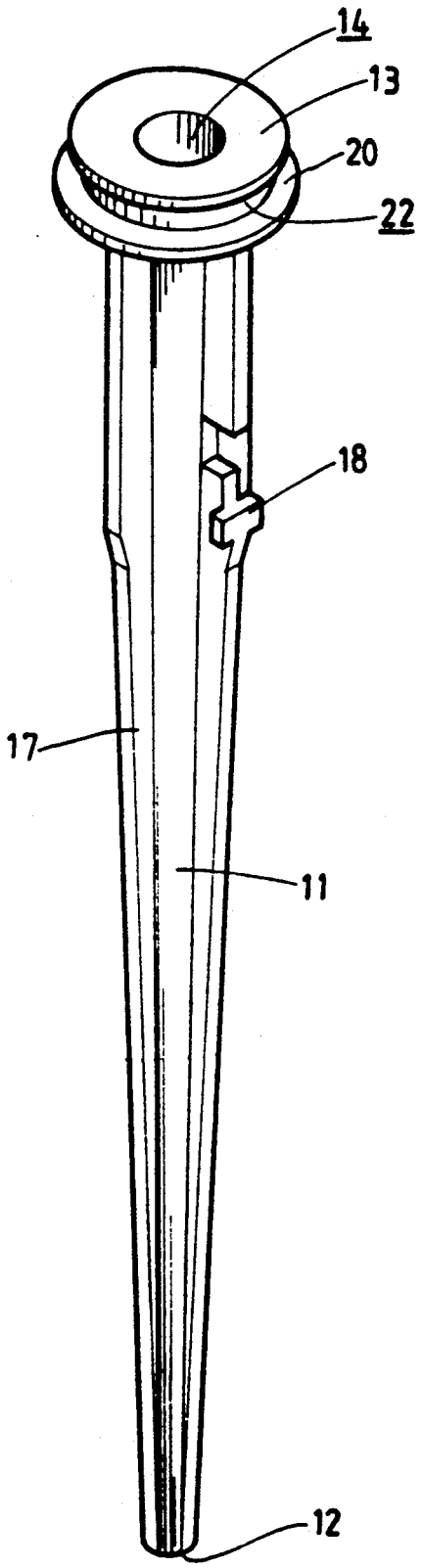
FIG. 1 is a perspective view of a decorative lamp post in accordance with the present invention.
Figure 2:
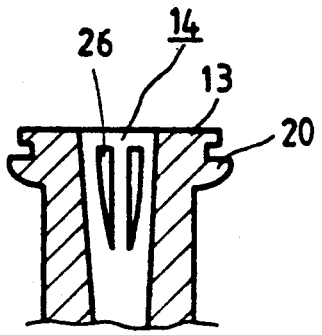
FIG. 2 is a partial cross-sectional view taken in a radial section of the post shown in FIG. 1.
Figure 5:
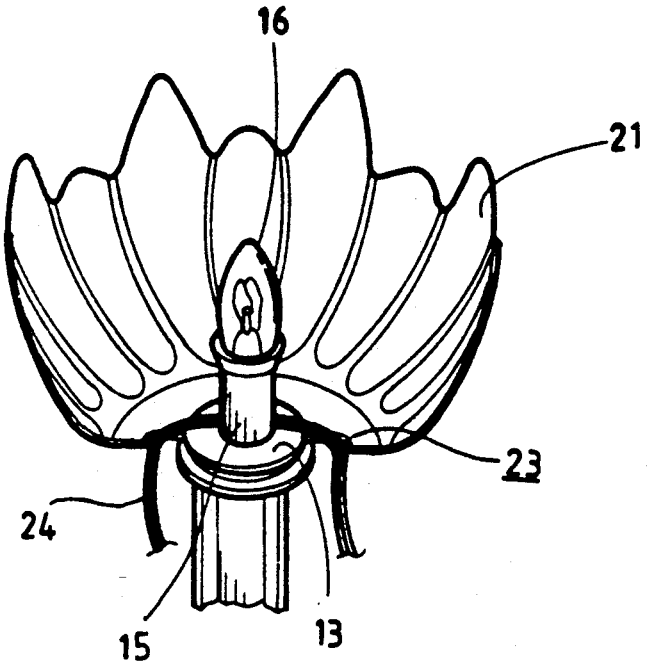
FIG. 5 is a third embodiment of using the post shown in FIG. 1.

With reference to the drawings and in particular to FIGS. 1 and 2, a decorative lamp post in accordance with the present invention, generally designated with the reference numeral 10, comprises a slender post body 11 having a sharpened end 12 and an expanded end, preferably in the form of a disk 13. Formed on the disk 13 is a hole 14 having a size suitable for receiving therein a socket 15 of a lamp 16 (FIG. 5). A plurality of fin-like members 17, preferably four, are fixed on the post body 11 extending along the length thereof. A hook-like member 18 may be formed on approximately the middle of at least one of the fin-like members 17. A second lamp 19 may be hanged on the hook-like member 18 (FIG. 3).

Figure 7:
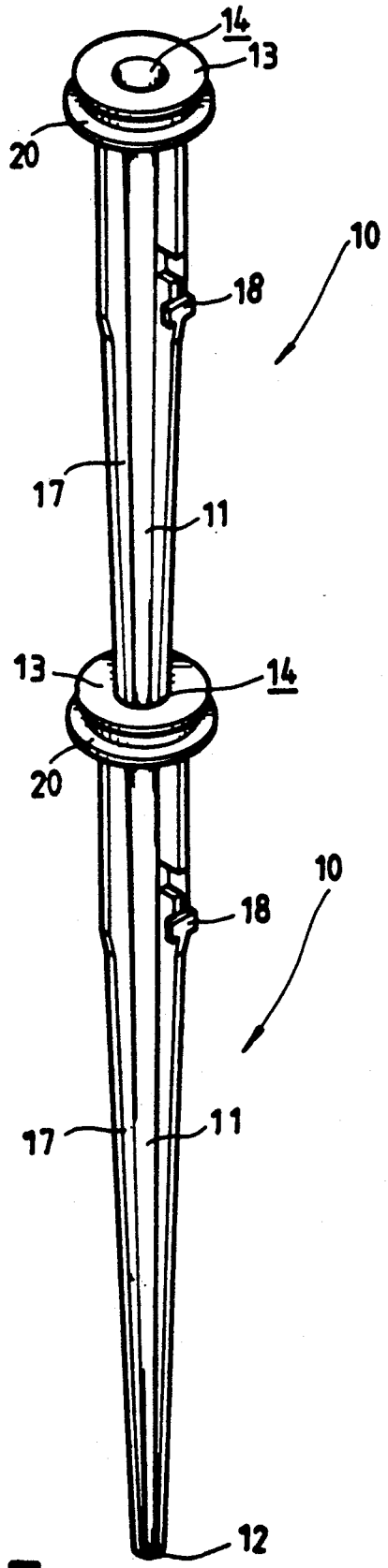
FIG. 7 is a perspective view showing a hole in a first post body accepting the sharpened end of a second post body to adjust the length of the post.

Inside the hole 14, a plurality of guiders 26, corresponding in number and geometrical locations to the fin-like members 17, for guiding the insertion of the sharpened end of a second decorative lamp post as shown in FIG. 7 of the present invention. In this manner, the height of the decorative lamp post of the present invention can be adjusted to fit for the environment of an outdoor party.

Figure 3:
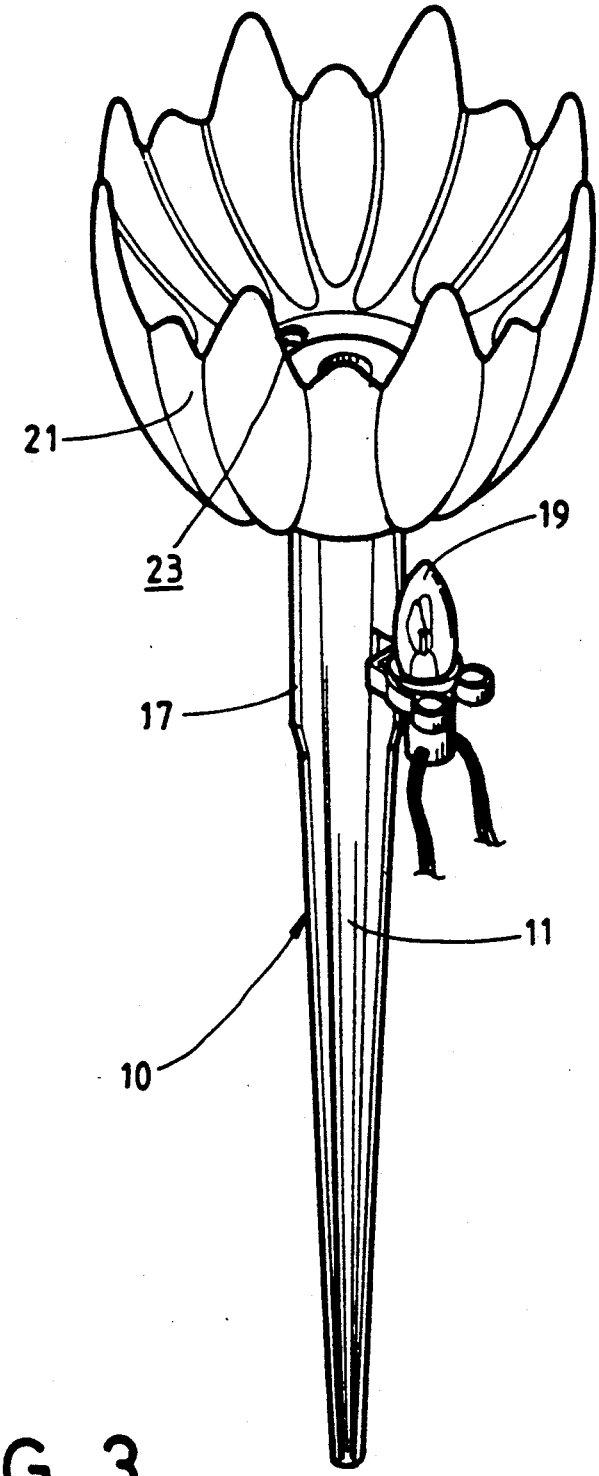
FIG. 3 is a first embodiment of using the post shown in FIG. 1.
Figure 6:
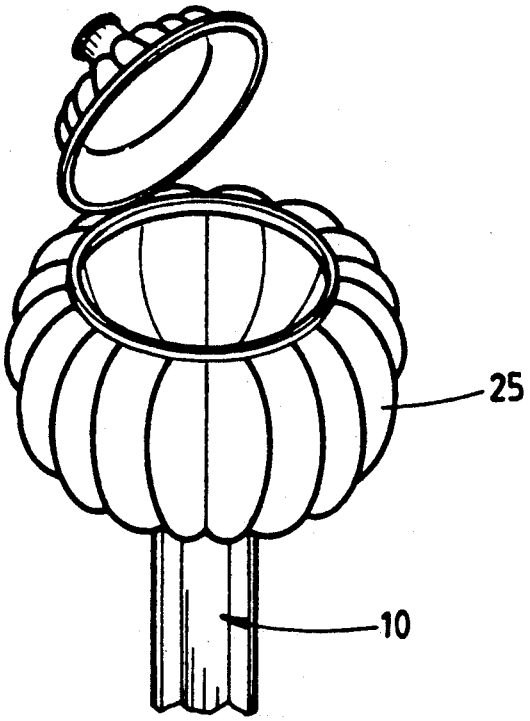
FIG. 6 is a fourth embodiment of using the post shown in FIG. 1.

A circumferential flange 20 is formed on the connection between the disk 13 and the post body 11 for supporting thereon a lamp-shade 21 (see FIGS. 3, 5 and 6). For further securing the lamp-shade 21, a circumferential slot 22 may be formed between the disk 13 and the circumferential flange 20 to receive therein a flange of the lamp-shade 21 and thus securing the lamp-shade 21. It is understood that the structure of the slot 22 and the flange 21 is for securing a lamp-shade 21 or the like and the structure may be substituted by any known securing means without departing the scope of the invention.

Figure 4:
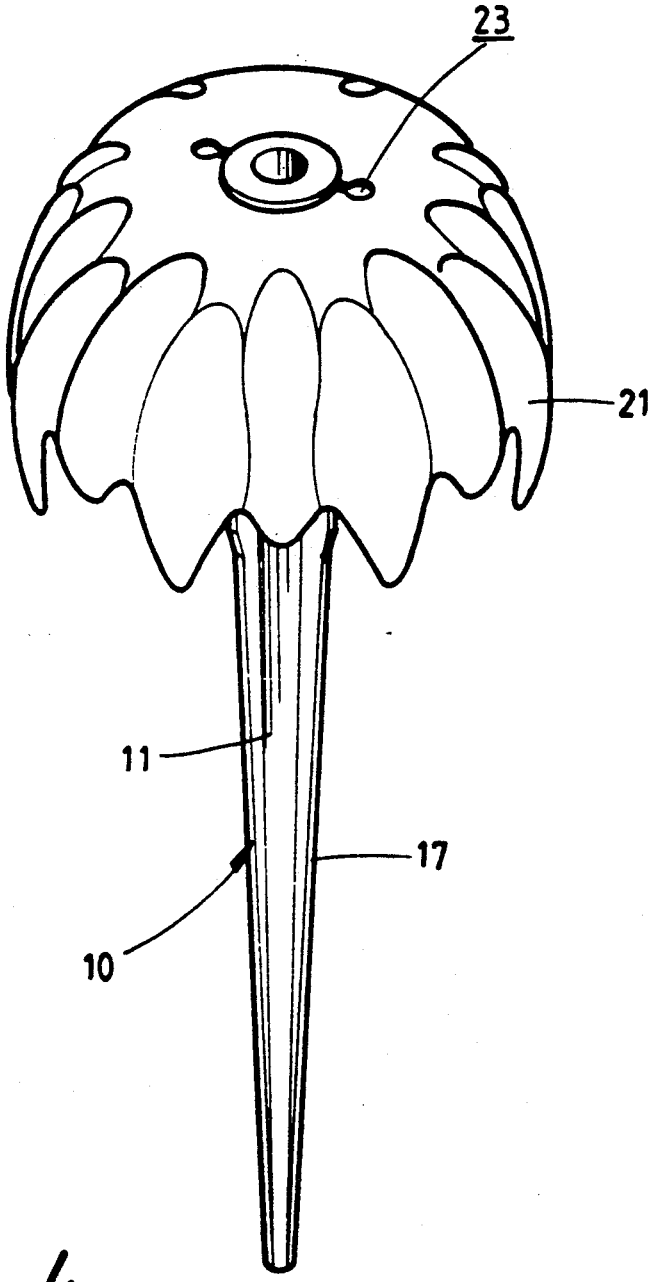
FIG. 4 is a second embodiment of using the post shown in FIG. 1.

Further referring to FIGS. 3 and 4, the installation of a lamp-shade 21 is shown. It is understood that a lamp-shade 21 with a romantic shape and color, preferably transparent with such a color, can be mounted on the post body 11 to enhance the romantic and passionate atmosphere thereof. The installation of the lamp 19 and/or 16 can be in either way shown in FIGS. 3 and 5.

A plurality of drains, preferably in the form of through holes 23 are formed on the lamp-shade 21 to exhaust the rain or other liquids accidently accumulated inside the lamp-shade 21, if the lamp-shade is in use. The holes 23 can also be used for fixing wires 24 of the first lamp 16 mounted on the hole 14 (FIG. 5).

Referring to FIG. 6, the lamp-shade 21 may be replaced by a container 25 for depositing therein candies and/or cookies (not shown) for satisfying the guests of the party. It is understood that the container 25 may be assumed any loving configuration, for example, a pumpkin for using at Halloween.

It is apparent that although the invention has been described in connection with the preferred embodiments, it is contemplated that those skilled in the art may make changes to certain features of the preferred embodiment without altering the overall basic function and concept of the invention and without departing from the spirit and scope of the invention as defined in the appended claims.

What is claimed is:

1. A decorative lamp post comprising a post body of a length having a sharpened end for piercing into ground and fixed thereby and an expanded end, preferably in the form of a disk with a hole formed thereon, a plurality of longitudinal fin-like members extending along the length of said post body and fixed thereon, said hole being suitable for receiving therein a sharpened end of a second post body to adjust the length thereof and when not receiving a second post body being suitable for receiving therein a socket of a first lamp for holding the first lamp, a circumferential flange being formed between said disk and said post body for supporting thereon a cover-like member, a circumferential slot being further formed between said circumferential flange and said disk to secure said cover-like member;

and further comprising a plurality of guiding members formed inside said hole, corresponding in number to the fin-like members, to guide the insertion of the second lamp post into said hole.

2. A decorative lamp post as claimed in claim 1 wherein said cover-like member has a plurality of through holes for serving as drains.

3. A decorative lamp post as claimed in claim 1 wherein said cover-like member has a plurality of through holes for fixing electric wires of the first lamp.

4. A decorative lamp post comprising a post body of a length having a sharpened end for piercing into ground and fixed thereby and an expanded end, preferably in the form of a disk with a hole formed thereon, a plurality of longitudinal fin-like members extending along the length of said post body and fixed thereon, said hole being suitable for receiving therein the sharpened end of a second post body to adjust the length thereof and when not receiving a second post body being suitable for receiving therein a socket of a first lamp for holding the first lamp, a circumferential flange being formed between said disk and said post body for supporting thereon a cover-like member, a circumferential slot being further formed between said circumferential flange and said disk to secure said cover-like member;

wherein said cover-like member has a plurality of through holes for serving as drains.

5. A decorative lamp post comprising a post body of a length having a sharpened end for piercing into ground and fixed thereby and an expanded end, preferably in the form of a disk with a hole formed thereon, a plurality of longitudinal fin-like members extending along the length of said post body and fixed thereon, said hole being suitable for receiving therein the sharpened end of a second post body to adjust the length thereof and being suitable for when not receiving a second post body receiving therein a socket of a first lamp for holding the first lamp, a circumferential flange being formed between said disk and said post body for supporting thereon a cover-like member, a circumferential slot being further formed between said circumferential flange and said disk to secure said cover-like member;

wherein said cover-like member has a plurality of through holes for fixing electric wires of the first lamp.

* * * * *